US010465981B2

(12) United States Patent
Bernhardt et al.

(10) Patent No.: US 10,465,981 B2
(45) Date of Patent: Nov. 5, 2019

(54) REFRIGERATION AND/OR LIQUEFACTION DEVICE, AND ASSOCIATED METHOD

(71) Applicant: L'Air Liquide, Societe Anonyme pour l'Etude et l'Exploitation des Procedes Georges Claude, Paris (FR)

(72) Inventors: Jean-Marc Bernhardt, La Buisse (FR); Fabien Durand, Voreppe (FR); Vincent Heloin, Sanssenage (FR); Pierre Barjhoux, La Tronche (FR); Gilles Flavien, Grenoble (FR)

(73) Assignee: L'Air Liquide Societe Anonyme pour l'Etude et l'Exoloitation des Procedes Georqes Claude, Paris (FR)

( * ) Notice: Subject to any disclaimer, the term of this patent is extended or adjusted under 35 U.S.C. 154(b) by 584 days.

(21) Appl. No.: 14/651,833

(22) PCT Filed: Nov. 8, 2013

(86) PCT No.: PCT/FR2013/052683
§ 371 (c)(1),
(2) Date: Jun. 12, 2015

(87) PCT Pub. No.: WO2014/096585
PCT Pub. Date: Jun. 26, 2014

(65) Prior Publication Data

US 2015/0316315 A1 Nov. 5, 2015

(30) Foreign Application Priority Data

Dec. 18, 2012 (FR) ..... 12 62186

(51) Int. Cl.
*F25J 1/00* (2006.01)
*F25B 9/00* (2006.01)
(Continued)

(52) U.S. Cl.
CPC ..... *F25J 1/0007* (2013.01); *F25B 9/002* (2013.01); *F25J 1/0065* (2013.01); *F25J 1/0268* (2013.01);
(Continued)

(58) Field of Classification Search
CPC ..... F25J 1/0065; F25J 1/0268; F25J 1/0007; F25J 2210/42; F25J 2270/904;
(Continued)

(56) References Cited

U.S. PATENT DOCUMENTS 2,932,173 A * 4/1960 Mordhorst ..... F25J 1/0007 62/608
4,267,701 A * 5/1981 Toscano ..... F25J 1/0007 62/402
(Continued)

FOREIGN PATENT DOCUMENTS

FR 2 919 713 2/2009
JP 60-165597 8/1985
(Continued)

OTHER PUBLICATIONS

Wagner, Solutions for Liquid Nitrogen Pre-cooling in Helium refrigeration cycles, Jul. 2000, All pages.*
(Continued)

*Primary Examiner* — Keith M Raymond
*Assistant Examiner* — Webeshet Mengesha
(74) *Attorney, Agent, or Firm* — Christopher J. Cronin

(57) ABSTRACT

A device for refrigerating and/or liquefying a working gas comprising helium, the device comprising a looped working circuit for the working gas includes, in series, a compression station, a cold box, a heat exchange system exchanging heat between the cooled working gas and a user, the device further comprising an additional pre-cooling system comprising at least one tank of auxiliary cryogenic fluid, such as
(Continued)

liquid nitrogen, the cold box comprising a first cooling stage of the working gas comprising a first exchanger disposed at the output of the compression station as well as a second heat exchanger and a third heat exchanger, the first heat exchanger being of the aluminum plate-fin type, the second heat exchanger being of the tube or welded plate type, characterized in that the second and third heat exchangers are connected both serially and in parallel on the working circuit downstream of the first heat exchanger.

7 Claims, 3 Drawing Sheets

(51) Int. Cl.
*F25J 1/02* (2006.01)
*F25B 9/10* (2006.01)
*F25B 40/02* (2006.01)

(52) U.S. Cl.
CPC ..... *F25B 9/10* (2013.01); *F25B 40/02* (2013.01); *F25B 2339/024* (2013.01); *F25B 2339/046* (2013.01); *F25J 2210/42* (2013.01); *F25J 2250/02* (2013.01); *F25J 2270/904* (2013.01); *F25J 2270/912* (2013.01)

(58) Field of Classification Search
CPC ..... F25J 2270/912; F25B 9/004; F25B 9/10; F25B 40/02; F25B 2339/046; F25B 2339/024
See application file for complete search history.

(56) References Cited

U.S. PATENT DOCUMENTS 4,346,563 A * 8/1982 Hood ..... F25B 9/00 62/117
5,095,709 A * 3/1992 Billiot ..... F17C 9/02 60/618
7,409,834 B1 * 8/2008 Ganni ..... F25B 9/002 62/606
2009/0094992 A1 4/2009 Wang

FOREIGN PATENT DOCUMENTS

| | | |
|---|---|---|
| JP | 62-102812 | 5/1987 |
| JP | 63-32258 | 2/1988 |
| JP | 63-38863 | 2/1988 |
| JP | 63-194163 | 8/1988 |
| JP | 01-127860 | 5/1989 |
| JP | 01-244254 | 9/1989 |
| JP | 04-036552 | 2/1992 |
| JP | 04-273953 | 9/1992 |
| JP | 05-079715 | 3/1993 |
| JP | 06-123508 | 5/1994 |
| JP | 11-125438 | 5/1999 |
| JP | 2004-085095 | 3/2004 |
| JP | 2004-116433 | 4/2004 |
| JP | 2007-051565 | 3/2007 |
| JP | 2010-53602 | 11/2010 |
| WO | WO 2011 110 768 | 9/2011 |
| WO | WO 2011 117 499 | 9/2011 |
| WO | WO 2011/110768 | 9/2011 |
| WO | WO 2011/117499 | 9/2011 |

OTHER PUBLICATIONS

VenkataRao Ganni, Ln2 Pre-cooling/ 2K System processes/Typical Components, Mar. 8, 2011, All pages.*
International Search Report for PCT/FR2013/052683, dated Jan. 17, 2014.
French Search Report and Written Opinion for FR 1262186, dated Jul. 25, 2013.
Wagner, U., "Solutions for liquid nitrogen pre-cooling in helium refrigeration cycles," CERN, 2000.

* cited by examiner

REFRIGERATION AND/OR LIQUEFACTION DEVICE, AND ASSOCIATED METHOD

CROSS-REFERENCE TO RELATED APPLICATIONS

This application is a § 371 of International PCT Application PCT/FR2013/052683, filed Nov. 8, 2013, which claims § 119(a) foreign priority to French patent application 1262186, filed Dec. 18, 2012.

FIELD OF THE INVENTION

The present invention relates to a refrigeration and/or liquefaction device and to a corresponding method, more specifically, to a device for the refrigeration and/or liquefaction of a working gas containing helium or consisting of pure helium.

BACKGROUND

The invention relates notably to helium refrigerators/liquefiers generating very low temperatures (for example 4.5K in the case of helium) with a view to continuously cooling users such as superconducting cables or components of a plasma generation device ("TOKAMAK"). What is meant by a refrigeration/liquefaction device is notably the very low-temperature (cryogenic temperature) refrigeration devices and/or liquefaction devices that cool, and where appropriate liquefy, a gas with a low molar mass such as helium.

When the user is cooled down, which means to say when the user needs to be brought down from a relatively high starting temperature (for example 300K or above) to a determined low nominal operating temperature (for example around 80K). The refrigeration/liquefaction device is generally ill-suited to such cooling.

What happens, when heavy components (such as superconducting magnets for example) are cooled from ambient temperature down to 80K over a lengthy period (over a few tens of days), relatively hot and cold streams of helium (feed toward the user and return from the user) pass countercurrentwise through common exchangers. For the device to operate correctly though, it is necessary to limit the difference in temperature between these streams of helium (for example to a maximum difference of between 40K and 50K).

To do so, the device comprises an auxiliary pre-cooling system which supplies frigories during this cooling-down.

As illustrated notably in the article ("Solutions for liquid nitrogen pre-cooling in helium refrigeration cycles" by U. Wagner of CERN—2000), the pre-cooling system generally comprises a volume of liquid nitrogen (at constant temperature, for example 80K) which supplies frigories to the working gas via at least one heat exchanger.

These known pre-cooling systems do, however, have constraints or disadvantages.

Thus, it is necessary to mix helium at 80K with hotter helium (at ambient temperature or the temperature at which it returns from the user that is to be cooled).

In order to limit the consumption of liquid nitrogen it is moreover necessary to recover the frigories from the helium returning from the user that is to be cooled as the user is gradually cooled. These constraints on temperature difference and on performance require heat exchanger technologies that differ according to the various operating configurations (cooling-down, normal operation).

Thus, during normal operation (outside of the cooling-down phase), the exchangers need to have very high performance, i.e. low pressure drops and should not be faced with significant temperature differences. Heat exchangers suited to this normal operation comprise heat exchangers of the aluminum brazed plate and fin type. This type of exchanger can typically tolerate temperature differences of more than 50K between countercurrent fluids.

During the cooling-down of heavy users, the heat exchange performance required in the exchangers is not as high but remains high. By contrast, the temperature differences (because of the liquid nitrogen at constant temperature) become relatively great (greater than 50K).

When the helium temperatures in the circuits and exchangers are still high, the pressure drop is far greater than that required in normal operation.

Existing solutions for addressing these problems entail a main exchanger at the entrance to the cold box which provides an exchange of heat between the helium and the nitrogen. Other solutions make provision for this main exchanger to be split into several independent sections produced using different heat exchanger technologies according to the nature of the fluid (helium or nitrogen).

These solutions do not provide a satisfactory solution to the problems because the device is either ill-suited to normal operation or ill-suited to the cooling-down phase.

SUMMARY OF THE INVENTION

It is an object of the present invention to alleviate all or some of the prior art disadvantages disclosed hereinabove.

To this end, the device according to the invention, in other respects in accordance with the generic definition thereof given in the above preamble, is essentially characterized in that the second and third heat exchangers are connected both in series and in parallel to the working circuit downstream of the first heat exchanger, which means to say that the working gas cooled in the first heat exchanger can be admitted selectively to the second and/or to the third heat exchanger, and in that the second heat exchanger is immersed in a first volume of liquefied auxiliary gas.

The device includes a working circuit in the form of a loop for the working gas and comprising, in series:

- a working gas compression station equipped with at least one compressor,
- a cold box for cooling the working gas and comprising a plurality of heat exchangers arranged in series and at least one member for expanding the working gas,
- a system for the exchange of heat between the cooled working gas and a user,
- at least one return pipe returning to the compression station the working gas that has passed through the heat exchange system, the return pipe comprising at least one exchanger for warming the working gas, the device further comprising an additional system for pre-cooling the working gas at the exit from the compression station, the pre-cooling system comprising at least one volume of auxiliary cryogenic fluid such as liquid nitrogen, the volume being connected to the working circuit via at least one heat exchanger in order selectively to transfer frigories from the auxiliary fluid to the working gas, the cold box comprising a first working-gas cooling stage comprising a first exchanger arranged at the exit from the compression station and a second heat exchanger and a third heat exchanger, the first heat exchanger being of the aluminum plate and fin type, the second heat exchanger being of the welded plate or welded tube(s) type, this second heat exchanger being immersed in a bath for auxiliary cooling fluid.

Moreover, some embodiments of the invention may comprise one or more of the following features:

- the second heat exchanger is one of the following: a heat exchanger of the stainless steel or aluminum tubes type, a heat exchanger of the stainless steel or aluminum finned tube type, a stainless steel welded plate exchanger,
- the circuit comprises a bypass leg selectively bypassing the third heat exchanger allowing the working gas from the first and/or the second heat exchanger to selectively avoid the third heat exchanger in the working circuit,
- the device comprises a first discharge pipe discharging vaporized auxiliary fluid connecting an upper end of the first volume to a remote auxiliary fluid recovery system via a passage through the first heat exchanger,
- the first discharge pipe for vaporized auxiliary fluid comprises a bypass leg for selectively bypassing the first heat exchanger,
- the third exchanger is of the type effecting selective exchange of heat between the working gas and the auxiliary fluid, the device comprising a selective feed pipe connecting the first volume to the third heat exchanger in order to transfer frigories from the auxiliary fluid to the working gas in the third heat exchanger,
- the device comprises a second volume of fluid which is selectively fed with auxiliary fluid from an auxiliary-fluid source, and in that the third heat exchanger is immersed in said second volume in order to allow an exchange of frigories between the working gas and the auxiliary fluid of the second volume,
- the device comprises a second discharge pipe discharging vaporized auxiliary fluid connecting an upper end of the second volume to a remote auxiliary fluid recovery system via a passage through the first heat exchanger,
- the second discharge pipe for vaporized auxiliary fluid comprises a bypass leg for selectively bypassing the first heat exchanger,
- the second and third heat exchangers are connected both in series and in parallel to the working circuit at the exit of the first heat exchanger via a network of pipes and valves that form a parallel connection and a series connection between the two heat exchangers and a bypass line bypassing the second heat exchanger,
- the first volume is selectively fed with auxiliary fluid via a conveying pipe connected to a source of auxiliary fluid and equipped with a valve,
- the first heat exchanger is of the type that exchanges heat between different streams of working gas at different respective temperatures and comprises a first passage fed with what is referred to as hot high-pressure working gas leaving the compression station, a second passage countercurrent to the first passage and fed by the return pipe for working gas said to be cold and at low pressure and a third passage countercurrent with the first passage and fed with working gas said to be at medium pressure via a working circuit return pipe returning working gas from the cold box which has not passed through the heat exchange system.

The invention also relates to a method of cooling a user using a device for the refrigeration and/or liquefaction of a working gas in accordance with any one of the features above or below, in which the user is cooled via the heat-exchange system, the method involving a step of pre-cooling the user having an initial temperature of between 250K and 400K, in which step the working gas leaving the compression station is cooled by exchange of heat in the first heat exchanger then is subdivided into two streams of which a first stream is cooled in the second heat exchanger and then in the third heat exchanger and a second stream is cooled directly in the third heat exchanger, the auxiliary fluid vaporized in the first volume being discharged without giving up frigories to the first heat exchanger.

The invention also relates to a method of cooling a user using a device for the refrigeration and/or liquefaction of a working gas in accordance with any one of the features above or below, in which the user is cooled via the heat-exchange system, the method involves a step of pre-cooling the user having an initial temperature of between 250K and 150K, in which step the working gas leaving the compression station is cooled by exchange of heat in the first heat exchanger then in the second heat exchanger then is split into two streams of which a first stream is cooled in the third heat exchanger and a second stream avoids the third exchanger, the third exchanger being fed with auxiliary fluid to transfer frigories from the auxiliary fluid to the working gas in the third exchanger, the auxiliary fluid vaporized in the first volume and/or on contact with the third exchanger being discharged without giving up frigories to the first heat exchanger.

The invention also relates to a method of cooling a user using a device for the refrigeration and/or liquefaction of a working gas in accordance with any one of the features above or below, in which the user is cooled via the heat-exchange system, the method involving a step of pre-cooling the user having an initial temperature of between 150K and 95K, in which step the working gas leaving the compression station is cooled by exchange of heat in the first heat exchanger then in the second heat exchanger then in the third heat exchanger, at least part of the auxiliary fluid vaporized in the first volume and/or on contact with the third exchanger being discharged, giving up frigories to the first heat exchanger.

The invention also relates to a method of cooling a user using a device for the refrigeration and/or liquefaction of a working gas in accordance with any one of the features above or below, in which the user is cooled via the heat-exchange system, the method involving a step of pre-cooling the user having an initial temperature of between 95K and 80K, in which step the working gas leaving the compression station is cooled by exchange of heat in the first heat exchanger then only in the third heat exchanger, the auxiliary fluid vaporized on contact with the third exchanger being discharged, giving up frigories to the first heat exchanger.

The invention also relates to a method for cooling a user using a device for the refrigeration and/or liquefaction of a working gas in accordance with any one of the features above or below in which, following a possible pre-cooling phase, the device cools the user in what is referred to as nominal operation in which the working gas leaving the compression station is cooled by exchange of heat in the first heat exchanger then only in the third heat exchanger, the third exchanger being fed with auxiliary fluid in order to transfer frigories from the auxiliary fluid to the working gas in the third exchanger and in that the auxiliary fluid vaporized on contact with the third exchanger is discharged, giving up frigories to the first heat exchanger.

The invention may also relate to any alternative device or method comprising any combination of the features above or below.

BRIEF DESCRIPTION OF THE DRAWINGS

For a further understanding of the nature and objects for the present invention, reference should be made to the detailed description, taken in conjunction with the accompanying drawing, in which like elements are given the same or analogous reference numbers and wherein.

DETAILED DESCRIPTION OF THE INVENTION

Figure 1:
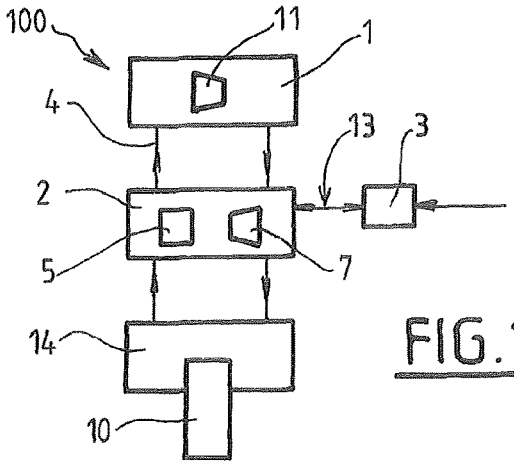
FIG. 1 depicts a simplified schematic and partial view illustrating the structure of a liquefaction/refrigeration device used for cooling a user member, FIG. 2 schematically and partially depicts a first example of a structure and operation of a liquefaction/refrigeration device used for cooling a user member, FIG. 3 schematically and partially depicts a detail of the cold box of a liquefaction/refrigeration device according to a second embodiment.

As depicted in FIG. 1, the plant 100 may in the conventional way comprise a refrigeration/liquefaction device comprising a working circuit subjecting the helium to a cycle of work in order to produce cold. The working circuit of the refrigeration device comprises a compression station 1 equipped with at least one compressor 5 and preferably several compressors which compress the helium.

On leaving the compression station station 1 the helium enters a cold box 2 for cooling the helium. The cold box 2 comprises several heat exchangers 5 which exchange heat with the helium in order to cool the latter. In addition, the cold box 2 comprises one or more turbines 7 to expand the compressed helium. For preference, the cold box 2 operates on a thermodynamic cycle of the Brayton type or any other appropriate cycle. At least some of the helium is liquefied on leaving the cold box 2 and enters a heat-exchange system 14 designed to provide a selective exchange of heat between the liquid helium and a user 10 that is to be cooled. The user 10 comprises, for example, a magnetic-field generator obtained using a superconducting magnet and/or one or more cryo-condensation pumping units or any other member requiring very-low-temperature cooling.

As indicated schematically in FIG. 1, the device further comprises, in a way known per se, an additional pre-cooling system for pre-cooling the working gas at the exit from the compression station 2. The pre-cooling system comprises a volume 3 of auxiliary cryogenic fluid such as liquid nitrogen. The volume 3 is connected to the working circuit via at least one heat exchanger in order selectively to transfer frigories from the auxiliary fluid to the working gas.

Figure 3:
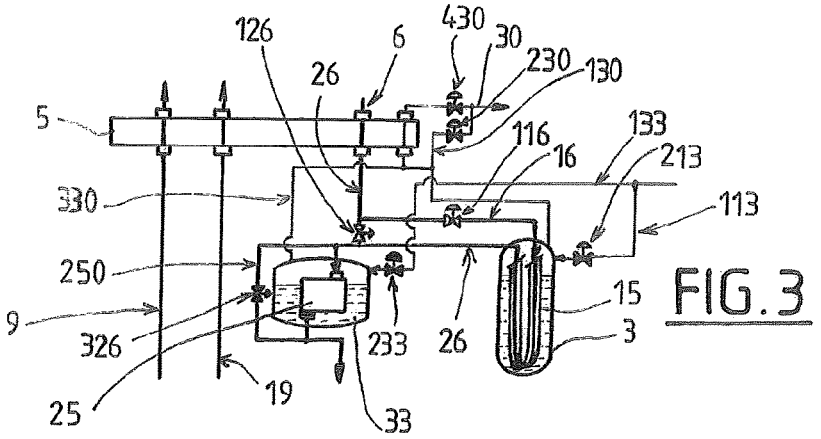

For example, the volume 3 may be fed with auxiliary fluid via a conveying pipe 113 connected to a source of auxiliary fluid (not depicted) and fitted with a valve 23 (cf. FIG. 3).

Figure 2:
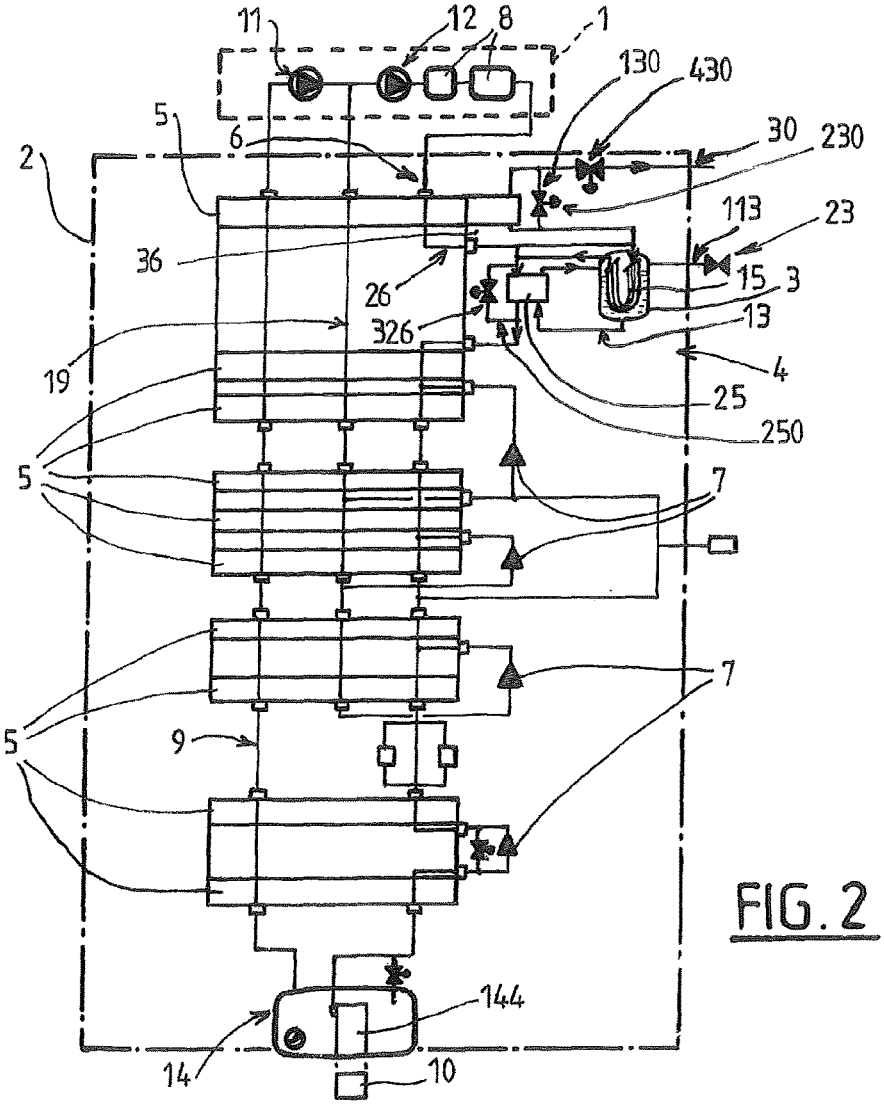

In the more detailed example of FIG. 2, the compression station 1 comprises two compressors 11, 12 in series defining for example three pressure levels for the helium. As indicated schematically, the compression station 2 may also comprise helium purification members 8.

At the exit from the compression station 1, the helium is admitted to a cold box 2 in which this helium is cooled by exchange of heat with several exchangers 5 and is in which it is expanded through the turbines 7.

The helium liquefied in the cold box 2 can be stored in a reservoir 14 provided with an exchanger 144 intended to exchange heat with the user 10 that is to be cooled, (for example a circuit equipped with a pump). This system 14 for the exchange of heat between the helium and the user 10 may comprise any other appropriate structure.

The low-pressure helium that has passed through the heat exchange system 14 is returned to the compression station 1 via a return pipe 9 in order to recommence a cycle of work. During this return, the relatively cold helium gives up frigories to the heat exchangers 5 and thus cools the relatively hot helium circulating in the opposite direction through the cold box 2 before reaching the user 10.

As illustrated, the working circuit may comprise a return pipe 19 returning to the compression station 1 helium from the cold box 2 that has not passed through the heat-exchange system 14.

As visible in FIG. 2, the device comprises a pre-cooling system comprising a volume 3 of auxiliary cryogenic fluid such as liquid nitrogen at a temperature of 80K for example.

The cold box 2 comprises a first helium-cooling stage which receives helium as soon as it leaves the compression station 1.

This first cooling stage comprises a first heat exchanger 5, a second heat exchanger 15 and a third heat exchanger 25.

The first heat exchanger 5 is preferably of the aluminum brazed plate and fin type. Such an exchanger for example meets the ALPEMA (aluminum plate-fin heat exchanger manufacturer's association) recommendations.

The first heat exchanger 5 is, for example, of the type in which there is an exchange of heat between different streams of helium at different respective temperatures. The first exchanger 5 may comprise a first passage 6 fed with working gas referred to as hot and at high pressure directly leaving the compression station 1, a second passage countercurrent to the first passage and fed by the return pipe 9 with working gas said to be cold and at low pressure, and a third passage countercurrent with the first passage and fed with working gas said to be at medium pressure via a return pipe 19. As described hereinafter, the first exchanger 5 further comprises a passage section for auxiliary fluid.

The second 15 and third 25 heat exchangers are connected both in series and in parallel to the working circuit downstream of the first heat exchanger 5, which means to say that the working gas cooled in the first heat exchanger 5 can be admitted selectively to the second 15 and/or third 25 heat exchanger.

As depicted in greater detail in FIG. 3, the second 15 and third 25 heat exchangers can be connected both in series and in parallel to the first heat exchanger 5 via a network of pipes 6, 16, 26, 250 and valves 116, 126, 326 forming a parallel connection and a series connection between the two heat exchangers 15, 25 and a bypass line 250 for bypassing the second heat exchanger 15.

As visible in FIG. 1, the second heat exchanger 15 is preferably of the tube type (the tube for example being made of stainless steel, copper or some other alloy compatible with cryogenic temperatures) immersed in a bath of auxiliary cooling fluid such as liquid nitrogen at 80K. More specifically, the second heat exchanger 15 is immersed in a first volume 3 of liquid nitrogen. As described earlier, the first volume 3 may be fed with auxiliary fluid via a conveying pipe 113 connected to a source of auxiliary fluid (not depicted) and equipped with a valve 23.

Of course, the invention is not restricted to this embodiment. Thus, for example, the immersed second heat exchanger 15 may be a heat exchanger made of stainless steel or some other metal or alloy with welded plates, namely a heat exchanger the technology of which is known under its English name of "plate and shell" type. These types of heat exchanger constituting the second heat exchanger 15 are able without disadvantage to withstand relatively high differences in temperature between the various configurations of use (immersed/non-immersed), for example temperature differences of between 60K and 250K.

The device comprises a first discharge pipe 30 for discharging vaporized auxiliary fluid and which connects an upper end of the first volume 3 to a remote auxiliary-fluid recovery system 131 via a passage through the first heat exchanger 5. This first pipe 30 for discharging vaporized auxiliary fluid also comprises a bypass leg 130 for selectively bypassing the first heat exchanger 5 via a system of valves 230, 430.

The third heat exchanger 25 is preferably an aluminum plate and fin type exchanger. The third exchanger 25 is of the type employing a selective exchange of heat between the helium and the nitrogen. For that, and as visible in FIG. 2, the device may comprise a feed pipe 13 equipped with at least one valve (not depicted) connecting (for example in a loop) the first volume 3 to the third heat exchanger 25 in order selectively to transfer frigories from the auxiliary fluid to the working gas in the third heat exchanger 25.

FIG. 3 illustrates an alternative form of embodiment of the first cooling stage of the device. The form of embodiment of FIG. 3 differs from that of FIG. 2 only in that the third heat exchanger 25 is this time immersed in a second volume 33 of auxiliary fluid (rather than being fed with auxiliary fluid from the first volume 3 or from a source). As illustrated in FIG. 3, this second volume 33 of fluid may be a cryogenic reservoir selectively fed with auxiliary fluid by an auxiliary-fluid source. The third heat exchanger 25 is immersed in said second volume 33 in order if appropriate to allow an exchange of frigories between the working gas and the auxiliary fluid of the second volume 33.

The second auxiliary volume 33 also comprises a second discharge pipe 330 for discharging vaporized auxiliary fluid and connecting an upper end of the second volume 30 to a remote auxilary-fluid recovery system via a passage through the first heat exchanger 5. For example, the second discharge pipe 330 connects to the first auxiliary-fluid discharge pipe 30 upstream of the first exchanger 5. What this means to say is that the vaporized auxiliary fluid in the second volume 33 can be split between a passage through the first exchanger 5 and/or the bypass line 130 avoiding this first heat exchanger 5.

FIGS. 4 to 7 respectively illustrate four distinct configurations that can be employed in a succession of one possible example of operation of the device.

Figure 4:
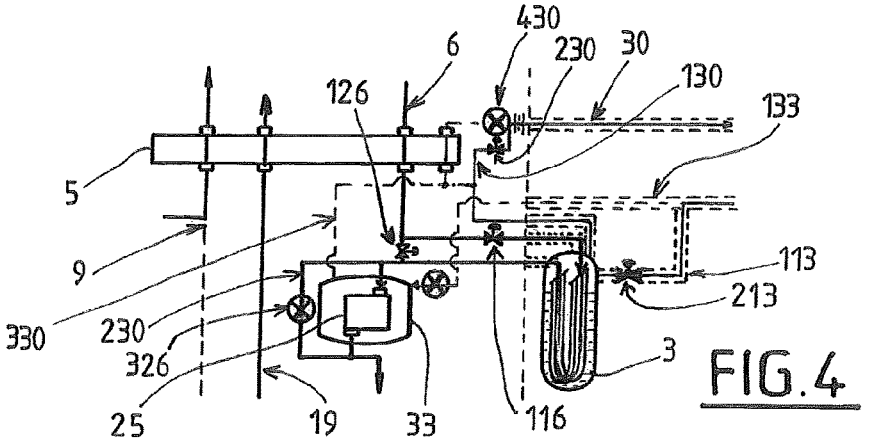
FIGS. 4 to 7 depict the detail of FIG. 3 in various distinct operating configurations respectively.

In a first phase of cooling down a user 10, which phase is illustrated in FIG. 4, the helium leaving the compression station 1 is cooled by exchange of heat in the first heat exchanger 5 then the cooled helium is subdivided into two streams (valves 116 and 126 open). A first of these two streams is cooled in the second heat exchanger 15 then enters the third heat exchanger 25 without exchange of heat (valve 233 closed). The second stream does not enter the second heat exchanger 15 and is mixed with the first stream leaving the second heat exchanger 15 before entering the third heat exchanger 25.

In this first phase, the first volume 3 is fed with auxiliary fluid (nitrogen) and the vaporized nitrogen is discharged by the discharge pipe 30 and the bypass leg 130 without giving up frigories to the first heat exchanger 5 (valve 230 open in the bypass leg 130 and valve 430 closed for entering the first exchanger 5).

This may correspond to the start of an operation of cooling down a user initially at a temperature of between 400K and 250K. During this first phase, the temperature of the helium may be:

- approximately equal to 300K at the exit from the first heat exchanger 5,
- approximately equal to 250K at the exit from the third heat exchanger 25.

Figure 5:
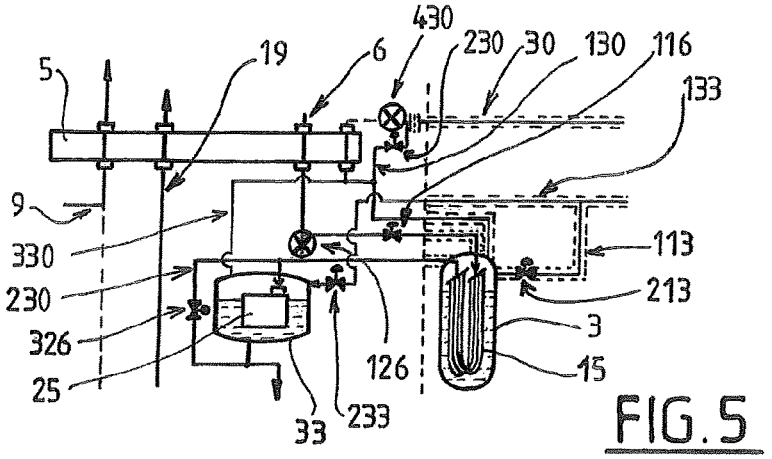

In a second phase of cooling down a user 10, which phase is illustrated in FIG. 5, the helium leaving the compression station 1 can be cooled by exchange of heat in the first heat exchanger 5 then in the second heat exchanger 15 (valve 116 open and valve 126 closed). The helium is then split into two streams of which a first stream is cooled in the third heat exchanger 25 and a second stream which passes through the bypass line 250 (opening of the valve 326 in the bypass line 250).

The first 3 and second 33 volumes are fed with auxiliary fluid via respective conveying pipes 113, 133 (corresponding valves 213 and 233 open). The vaporized auxiliary fluids in the volumes 3, 33 can be discharged without passing via the first heat exchanger 5, i.e. via the bypass leg 130 (valve 430 closed and valve 230 open).

This may correspond to an operation of cooling down a user initially at a temperature of between 250K and 150K. During this second phase, the temperature of the helium may be:

- approximately equal to 145K at the exit from the first heat exchanger 5,
- approximately equal to 120K at the exit from the second heat exchanger 15,
- approximately equal to 80K at the exit from the third heat exchanger 25,
- approximately equal to 120K in the bypass leg 130, and
- approximately equal to 95K after the junction downstream of the bypass leg 130.

Figure 6:
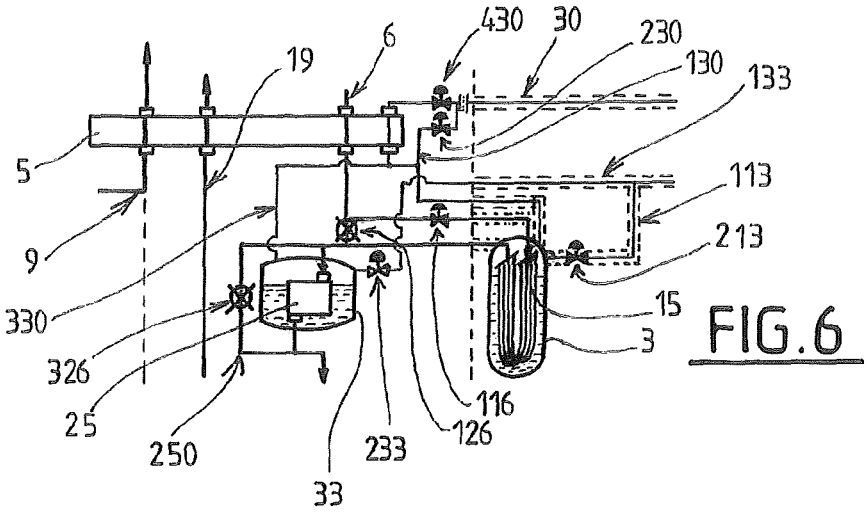

In a third phase of cooling down a user 10, which phase is illustrated in FIG. 6, the working gas leaving the compression station 1 may be cooled in series by exchange of heat in the first heat exchanger 5 then in the second heat exchanger 15 then in the third heat exchanger 25 (valve 116 open, valve 126 closed). The vaporized auxiliary fluid in the first 3 and second 33 volumes can be discharged partly via the first heat exchanger 5 and partly via the bypass leg 130 (valve 230 and 430 open).

This may correspond to an operation of cooling down a user initially at a temperature of between 150K and 95K. During this second phase, the temperature of the helium may be:

- approximately equal to 130K at the exit from the first heat exchanger 5,
- approximately equal to 100K at the exit from the second heat exchanger 15,
- approximately equal to 80K at the exit from the third heat exchanger 25.

Figure 7:
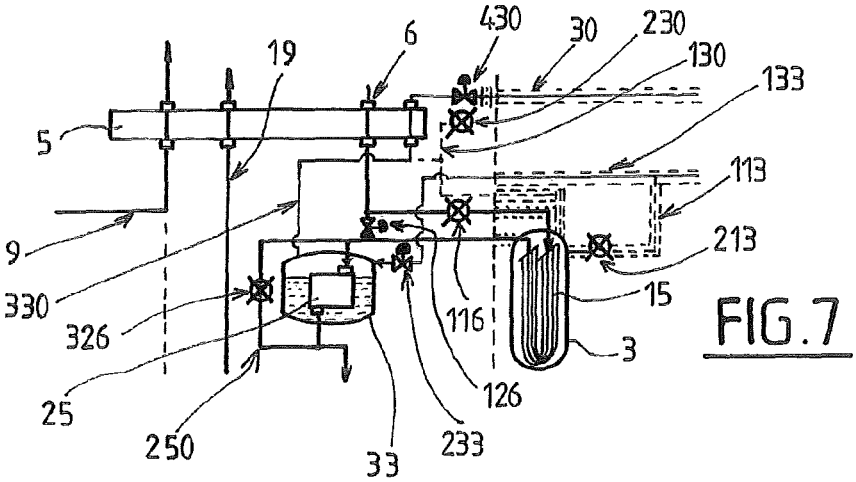

In a fourth phase of cooling down a user 10, which phase is illustrated in FIG. 7, the working gas leaving the compression station 1 may be cooled in series by exchange of heat in the first heat exchanger 5 then in the third heat exchanger 25 (without passing via the second heat exchanger 15: valve 116 closed and valve 126 open). Only the second volume 33 may be fed with auxiliary fluid (valve 213 closed and 233 open). The vaporized auxiliary fluid in the second volume 33 may be discharged partly via the first heat exchanger 5 and partly via the bypass leg 130 (valves 230 and 430 open).

This may correspond to an operation of cooling down a user initially at a temperature of between 95K and 80K. During this second phase, the temperature of the helium may be:

approximately equal to 95K at the exit from the first heat exchanger 5, approximately equal to 80K at the exit from the third heat exchanger 25.

Finally, when the user 10 has reached the determined low temperature of what is referred to as normal operation, the device may provide continuous cooling (maintain a level of coldness at the determined temperature) using the same device.

During this continuous cooling, the device may also operate according to the configuration of FIG. 7. What that means to say is that the working gas leaving the compression station 1 can be cooled in series by exchange of heat in the first heat exchanger 5 then in the third heat exchanger 25 (without passing via the second heat exchanger 15), and only the second volume 33 may be fed with auxiliary fluid. The vaporized auxiliary fluid in the second volume 33 may be discharged by the first heat exchanger 5 (valve 230 closed and valve 430 open).

During this mode of operation, the temperature of the helium may be:

approximately equal to 90K at the exit of the first heat exchanger 5, approximately equal to 80K at the exit of the third heat exchanger 25.

The architectures described hereinabove thus make it possible to cool down a massive component from a relatively hot temperature (for example 400K) to a relatively low temperature (for example 80K) with a reduced amount of equipment.

The use of two exchangers of the aluminum plate and fin type (first 5 and third 25 heat exchanger) and of a heat exchanger of the tube type (second exchanger 15) makes it possible to optimize the operation of the device for the various phases of operation that are the pre-cooling and operation referred to as normal operation (after pre-cooling).

These configurations notably make it possible to position the second heat exchanger 15 outside the cold box 2 and therefore also the first volume 3.

Another advantage afforded by the device is that it limits the ingress of heat into the working gas during normal operation by isolating the circuits and equipments used only for the cooling-down. These equipments may be installed away from the cold box and that likewise reduces the size and cost of the cold box chamber.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "an" and "the" include plural referents, unless the context clearly dictates otherwise.

"Comprising" in a claim is an open transitional term which means the subsequently identified claim elements are a nonexclusive listing i.e. anything else may be additionally included and remain within the scope of "comprising." "Comprising" is defined herein as necessarily encompassing the more limited transitional terms "consisting essentially of" and "consisting of"; "comprising" may therefore be replaced by "consisting essentially of" or "consisting of" and remain within the expressly defined scope of "comprising".

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

What is claimed is:

1. A device for refrigeration and/or liquefaction of a working gas containing helium or consisting of pure helium, the device comprising a working circuit in form of a loop for the working gas and comprising, in series:

a working gas compression station equipped with at least one compressor;

a cold box comprising a plurality of heat exchangers for cooling the working gas and at least one expander for expanding the working gas, the plurality of heat exchangers comprising a plurality of first heat exchangers arranged in series, a second heat exchanger, and a third heat exchanger;

an end-use heat exchanger for exchange of heat between the cooled working gas and a user wherein the user is a super conducting cable;

at least one return pipe returning to the working gas compression station the working gas that has passed through the plurality of first heat exchangers and warmed by the working gas compression station, an upstream-most one of the plurality of first heat exchangers being arranged at the exit from the working gas compression station and being of an aluminum plate and fin type, and the device further comprising:

at least one volume of liquefied auxiliary gas, the at least one volume of liquefied auxiliary gas being connected to the working circuit via at least one of the second heat exchanger and the third heat exchanger in order to selectively transfer heat between the at least one volume of liquefied auxiliary gas and the working gas, the second heat exchanger being of a welded plate or welded tube(s) type, the second heat exchanger being immersed in a bath for auxiliary cooling fluid, wherein:

the second and third heat exchangers are connected both in series and in parallel to the working circuit downstream of said upstream-most one of the plurality of first heat exchangers so that the working gas cooled in the upstream-most of the plurality of first heat exchangers can be admitted selectively to the second and/or to the third heat exchanger, the at least one volume of liquefied auxiliary gas comprises at least a first volume of liquefied auxiliary gas, and the second heat exchanger is immersed in the first volume of liquefied auxiliary gas.

2. The device of claim 1, wherein the second heat exchanger is one of the following: stainless steel tubes, aluminum tubes, or a stainless steel welded plate exchanger, wherein the stainless steel tubes or the aluminum tubes are optionally finned.

3. The device of claim 1, wherein the working circuit comprises a bypass leg selectively bypassing the third heat exchanger allowing the working gas from said upstream-most one of the plurality of first heat exchangers being arranged at the exit of the compression station and/or from the second heat exchanger to selectively avoid the third heat exchanger in the working circuit.

4. The device of claim 1, wherein the third exchanger is adapted and configured to effect selective exchange of heat between the working gas and the at least one volume of liquefied auxiliary gas, the device comprising a selective feed pipe connecting the at least one volume of liquefied auxiliary gas to the third heat exchanger in order to transfer heat between the at least one volume of liquefied auxiliary gas and the working gas in the third heat exchanger.

5. The device of claim 1, wherein the at least one volume of liquefied auxiliary gas comprises the first volume of liquefied auxiliary gas and a second volume of liquefied auxiliary gas, the second volume of liquefied auxiliary gas is selectively fed with liquefied auxiliary gas from a liquefied auxiliary gas source, and the third heat exchanger is immersed in said second volume of liquefied auxiliary gas in order to allow an exchange of heat between the working gas and the liquefied auxiliary gas of the second volume.

6. A method of cooling a user using the device of claim 1, the method comprising a step of pre-cooling the user having an initial temperature of between 250K and 400K through heat exchange, via the end-use heat exchanger, between the user and the working gas cooled by the plurality of heat exchangers, wherein:

the working gas leaving the working gas compression station is cooled by exchange of heat in said upstream-most one of the plurality of first heat exchangers, then is subdivided into two streams of which a first stream is cooled in the second heat exchanger, and then in the third heat exchanger, a second stream is cooled directly in the third heat exchanger, and an amount of liquefied auxiliary gas vaporized in the at least one volume of liquefied auxiliary gas is discharged without giving cooling to the upstream-most one of the plurality of first heat exchangers.

7. A method of cooling a user using a device for refrigeration and/or liquefaction of a working gas as claimed in claim 1, wherein the user is cooled via the end use heat exchanger.

* * * * *